United States Patent [19]

Properzi

[11] 4,090,383

[45] May 23, 1978

[54] DEVICE FOR EXTRACTING WIRE ROD OR THE LIKE AT THE OUTLET END OF A ROLLING MILL

[76] Inventor: Giulio Properzi, Via Pietro Cossa, 1, Milan, Italy

[21] Appl. No.: 771,727

[22] Filed: Feb. 24, 1977

[30] Foreign Application Priority Data

Mar. 1, 1976 Italy ..... 20723 A/76

[51] Int. Cl.[2] ..... B21C 47/00

[52] U.S. Cl. ..... 72/134; 242/82; 206/106

[58] Field of Search ..... 72/66, 134, 135; 140/1, 140/2, 102; 266/106; 242/82

[56] References Cited

U.S. PATENT DOCUMENTS

| | | | |
|---|---|---|---|
| 3,469,429 | 9/1969 | Dopper et al. | 72/134 |
| 3,490,500 | 1/1970 | Dopper et al. | 266/106 |
| 3,780,963 | 12/1973 | Hirschfelder | 242/82 |

*Primary Examiner*—Leon Gilden

*Attorney, Agent, or Firm*—Guido Modiano; Albert Josif

[57] ABSTRACT

There is disclosed a device for extracting the end portion of wire rod from a laying guide of an Edenborn coiler arranged downstream of a wire rod rolling mill. The device includes an extractor cylinder idly supported by the laying cone of the coiler so as to be substantially stationary during rotation of the coiler or to slightly rotate in a direction opposite to that of the coiler. The cylinder has a diameter slightly smaller than that of the formed coils and a length such as to comprise at least one turn of the deposited coils. When the end portion of the wire rod has leaved the rolling mill and is no more dragged by pinch rollers or the like at the output of the rolling mill, the speed thereof decreases due to friction against the walls of the output guide located between the rolling mill and the coiler. The diameter of the coils therefore also decreases and the wire rod winds around the extractor cylinder which has a relative speed with respect to the coiler, thus causing the end portion of the wire rod to be extracted from the continuously rotating laying guide of the coiler.

3 Claims, 2 Drawing Figures

1
2
3
4
5
6
7
8
9
10
11
12
13
14
15
16
17
18
18a
19
II

DEVICE FOR EXTRACTING WIRE ROD OR THE LIKE AT THE OUTLET END OF A ROLLING MILL

BACKGROUND OF THE INVENTION

This invention relates to a device for extracting wire rod or the like at the outlet end of a rolling mill, and more particularly to a device for extracting the end portion of wire rod or the like from the laying guide of an Edenborn type of coiler intended for coiling the wire rod in loose turns at a rolling mill outlet.

The device is intended for use with a rolling mill operating intermittently starting from billets, or with a continuously operated rolling mill located downstream of a continuous casting machine.

As is known, an Edenborn type of coiler comprises a rotary laying cone, provided with a tubular laying guide the inlet portion of which is disposed aligned with the guide end portion which normally connects the rolling mill to the coiler, and the outlet portion of which is substantially tangent to the base circle of the laying cone and slightly inclined downwardly. The wire rod from the rolling mill, guided by the laying guide, is deposited in the form of a cylindrical coil as a result of the laying guide rotary motion overlapping the forward movement of the wire rod. The turns forming the cylindrical coil may be deposited directly on a continuous conveyor, which carries them to collecting baskets or other collecting means.

A collecting system of this type is described in U.K. Patent Specification No. 1,417,009 of the same applicant, in which part of the conveyor and coiler is immersed in water to prevent the wire rod oxidizing.

This wire rod collecting system is particularly suitable for rolling mills of high production speed, as is the case of modern wire rod rolling mills.

However, this system has a disadvantage which up to the present time it has not been possible to satisfactorily eliminate, and which occurs in particular when operating under low speed conditions with small diameter wire rod. In this respect, at the end of each working cycle (and thus very often when the rolling mill operates discontinuously starting from billets) the last few meters of rolled wire rod, which constitute the wire rod end portion, leave the last rolling assembly and the conveying means upstream of the coiler, and proceed into the laying guide only by the effect of their force of inertia, which is opposed by the friction force arising as the wire rod rubs against the inner surface of the laying guide.

At low speeds and small rod diameters, and thus with only a small moving mass, the wire rod inertia is not sufficient to overcome the friction force, because of which the wire rod end portion stops in the laying guide which, continuing to rotate, takes up the already deposited rod, twisting it and unwinding the turns lastly deposited, with considerable economical damage both in terms of the loss of part of the production and the time necessary to restore the efficiency of the plant.

This phenomenon may also occur in the case of higher speeds and larger diameters when there are no conveying means upstream of the coiler, the wire rod then being thrust by the rolls of the last rolling assembly.

Various methods have been studied for preventing this disadvantage, but they are either considerably complicated in construction and therefore of high cost, or do not act automatically, even through some are effective in extracting the wire rod.

One of these methods consists of guiding the wire rod immediately downstream of the outlet section of the laying guide between the inner wall of a fixed cylinder of internal diameter equal to the external diameter of the turns being formed, and a roller disposed inside the turns and rotatably supported by a swinging arm the pivot of which is rigid with the laying cone, and gripping the wire rod between the cylinder wall and roller at the moment of extraction, by thrusting the roller against the cylinder by a mechanical or electromagnetic control. By gripping the wire rod, it is prevented from assuming the same speed as the laying cone and the wire rod is therefore disengaged from the laying cone.

The main disadvantage of this device is that the roller does not operate automatically, but at a command by an operator. This is an important point, especially when the plant stoppage is not programmed. This manual operation requires a certain ability for intervening at the correct moment and definitely preventing any starting of the described twisting.

Other devices are known which dispense with the intervention of the operator, and use extraction devices arranged to remain in operation during the entire processing, but these devices introduce mechanical stresses and friction which are undesirable, and also represent complex solutions of complicated construction and therefore decidedly costly.

SUMMARY OF THE INVENTION

The fundamental object of the present invention is to provide an extractor device for extracting the end of the wire rod or the like from the laying guide of an Edenborn coiler disposed at the outlet of a rolling mill, said device not presenting any of the aforesaid disadvantages but being constructed in such a manner as to commence operating automatically without the intervention of any operator, and to remain inactive during the laying of the turns, therefore introducing no additional friction or undesirable stress during the laying of the turns.

A further object of the present invention is to provide an extractor device as specified, of simple construction, not requiring electrical or mechanical control members for the automatic intervention, and therefore of minimum cost besides being of reliable operation.

These and further objects, which will be more evident hereinafter, are attained by a device for extracting wire rod or the like from the laying guide of an Edenborn coiler disposed at the outlet of a rolling mill, said device comprising an extractor cylinder idly supported by the laying cone of said coiler and coaxial thereto, said cylinder having an external diameter less than the internal diameter of the turns formed by said laying cone, and a length sufficient to comprise at least one of said turns, the device also comprising means for maintaining a relative speed beween said extractor cylinder and said laying cone.

In a device of this type, the deceleration of the wire rod relative to the laying cone, arising from the fact that the wire rod is no longer subjected to the conveying devices or to the thrust of the last rolling assembly and is therefore affected by the friction during its movement, leads to a reduction in the diameter of the turns formed at the laying cone outlet. This results in the turns of the cylindrical coil becoming clamped about the extractor cylinder, which is hindered relative to the laying cone which continues to rotate, and brakes the wire rod by friction, the result being that the end portion of the wire rod withdraws from the guide of the rotating laying cone. However this latter continues to rotate, as it is not normally possible to stop the coiler both because of the masses concerned and the fact that the rolling mill rapidly recommences a new rolling cycle.

With the device according to the invention, the intervention is made automatic by the fact that it is precisely the reduction in the wire rod feed speed into the laying guide itself, this being the first effect of the phenomenon to be avoided, which starts the extraction operation. The inactivity of the device during the normal turn laying operation is ensured by the fact that the diameter of the extractor cylinder is less than the diameter of the turns being formed, so preventing contact between the turns and the cylinder and therefore any undesirable friction or mechanical stress during normal operation.

Preferably said means for maintaining a relative speed between the extractor cylinder and laying cone comprise a plurality of fixed nozzles arranged to feed fluid jets on to shaped surfaces of the extractor cylinder, the orientation of said nozzles and said surfaces being such as to create a couple opposing the rotation of the extractor cylinder in the direction of rotation of the laying cone.

Advantageously, means are provided for adjusting the flow of said fluid jets, said means being adjustable so as to keep the extractor cylinder at rest or in slow rotation in the opposite direction to the direction of rotation of the laying cone, at least at the beginning of extraction.

The initial speed of the extractor cylinder, preferably zero or low in the opposite direction to the direction of rotation of the laying cone, together with the moment of inertia of the extractor cylinder, are of considerable importance to the braking action of the wire rod dragged by the laying guide. In this respect, the two quantities must be such as to maintain a sufficiently high relative speed between the wire rod end portion and laying guide during the entire time necessary for completely withdrawing the wire rod end portion, as this withdrawal is more rapid the higher the relative speed.

The wire rod, constrained to the extractor cylinder by friction, has a speed relative to the laying cone which progressively decreases and tends to zero as the extractor cylinder is subjected to a certain acceleration due to the resultant of the friction forces acting on the wire rod end portion, said acceleration being inversely proportional to the moment of inertia of the cylinder.

Thus in order to prevent the disappearance of said relative speed before the extraction operation is complete, and to contain the extraction time between acceptable limits and therefore optimize the operation, the device according to the invention offers the possibility of varying two parameters, i.e. the initial speed of the extractor cylinder and the moment of inertia of the extractor cylinder.

The use of the fluid jets and the means for adjusting the jet flow advantageously allows that by varying the flow rate, and thus influencing the couple transmitted to the extractor cylinder, the angular speed of the extractor cylinder, and in particular its initial angular speed, may be varied.

Practical experience has shown that to obtain best results it is preferable to keep the extractor cylinder at rest or in slow rotation in the opposite direction to the direction of rotation of the laying cone, this being possible by a suitable choice of fluid jet flow and the moment of inertia of the cylinder by adjusting its weight and the distribution of the masses of the cylinder.

Once the wire rod end portion has been completely extracted from the laying guide, the end portion is easily recovered as the last part thereof rapidly tends to unwind from the extractor cylinder, dragging with it the already wound turns, the unwinding being facilitated by the action of the fluid jets, which act on the extractor cylinder in a direction corresponding to the direction of unwinding of the turns.

BRIEF DESCRIPTION OF THE DRAWINGS

Further characteristics and advantages of the invention will be more evident from the detailed description given hereinafter by way of non-limiting example of a preferred embodiment of the invention illustrated in the accompanying drawing in which.

DESCRIPTION OF THE PREFERRED EMBODIMENTS

Figures 1, 2:
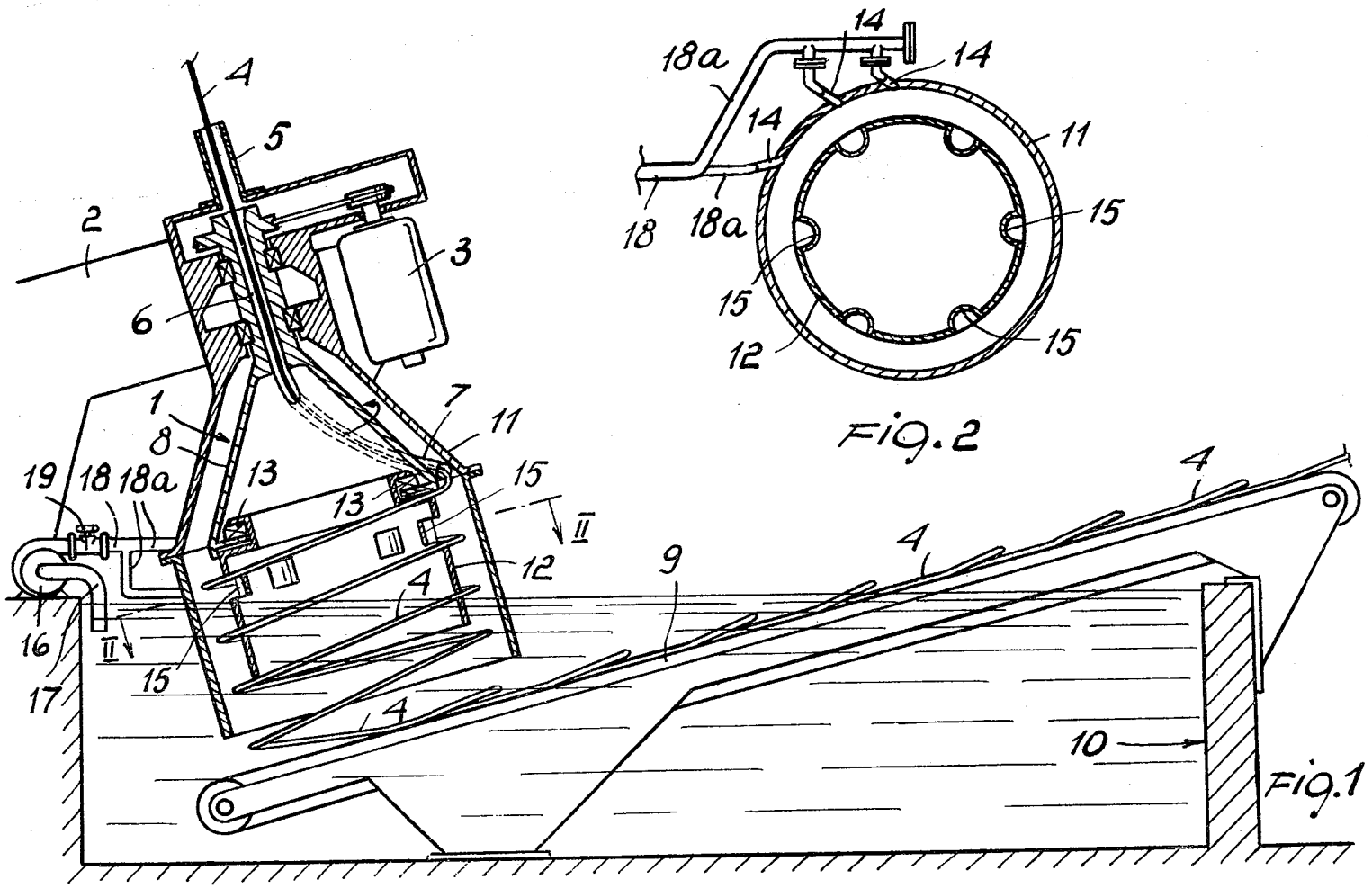
FIG. 1 is a partially sectional lateral view of a wire rod collecting apparatus disposed at the outlet of a rolling mill and provided with the device according to the invention.
FIG. 2 is a cross-section through the coiler and extractor cylinder on the line II—II of FIG. 1, the cross-section being limited to the extractor cylinder and the external coiler guard to show the conduits leading to the delivery nozzles for the fluid jets.

The wire rod collecting device shown in the drawing and to which the extractor device according to the invention is fitted, is of the type described in U.K. Pat. Specification No. 1,417,009 of the same applicant. This comprises an Edenborn coiler 1 rotatably supported by a frame 2 and rotated by an electric motor 3. The wire rod 4, coming from the deviator and conveying devices of the rolling mill (not shown), reaches the coiler 1 in a guide 5 and traverses an axial passage 6 of the coiler, which continues in the form of a tubular laying guide 7 rigid with the laying cone of the coiler 8. The rotation of the laying head 7, 8 and the feed movement of the wire rod 4 cause the wire rod to deposit in the form of turns on a continuous conveyor 9 inclined in a tank 10 containing a cooling fluid, the inclination being such that after the turns travel along a path of suitable length in the cooling fluid, they leave it having been cooled by the cooling fluid, and are collected in collecting baskets or other collection means, not shown. A cap 11, extending from the frame 2 to below the surface of the cooling fluid around the coiler 1, advantageously protects the wire rod from the oxidizing action of the atmosphere. This however is a provision which is not strictly necessary from the point of view of the present invention.

According to the invention, the extractor device associated with the described collection apparatus comprises an extractor cylinder 12 rotatably supported by the laying cone 8 and coaxial thereto, by means of bearings 13. The extractor cylinder 12 has an external diameter slightly less than the internal diameter of the turns formed by the coiler 1, i.e. the diameter of the circle described by the terminal end of the laying guide 7. Advantageously, the axial length of the extractor cylinder 12 is sufficient to comprise at least one of the turns of the cylindrical coil formed, and for example sufficient to comprise three turns as shown. The extractor device also comprises means for maintaining a relative speed between the extractor cylinder 12 and laying cone 8. Said means are advantageously constituted by a plurality of fixed nozzles 14 arranged to feed fluid jets on to shaped surfaces 15 of the extractor cylinder 12 in such a direction as to create a couple opposing the rotation of the cylinder 12 in the direction of rotation of the laying cone 8. In the embodiment shown, che cooling fluid in the tank 10 is used as the fluid fed on to the surfaces 15 of the extractor cylinder 12. For this purpose a pump 16 is provided, with a suction pipe 17 dipping into the liquid in the tank 10 and a delivery pipe 18 branching in the form of several conduits 18*a* terminating in the nozzles 14. A valve 19 is also provided for adjusting the fluid flow rate. The inclination of the nozzles 14 to the extractor cylinder 12 and the fluid flow rate are adjusted, as already stated, preferably in such a manner as to convert the jet energy into an opposing couple equal or greater than the couple due to the motion of the laying cone and transmitted to the extractor cylinder 12 by the friction of the bearings 13, the opposing couple being sufficient to maintain the extractor cylinder 12 at rest or in slow rotation in the opposite direction to the direction of rotation of the laying cone 8.

The operation of the described device is as follows.

On termination of the rolling cycle, the decreased speed of the wire rod 4 relative to the laying guide 7 and arising from the cessation of the action on the wire rod by the conveying means upstream of the coiler and the fact that the friction forces prevail over the force of inertia of the wire rod, cause the turns to clamp around the extractor cylinder 12, which provides an opposing moment to the moment of the friction forces which is proportional to its own moment of inertia. The clamping of the turns around the substantially fixed cylinder 12 causes the wire rod end portion to withdraw from the laying guide 7, which continues to rotate.

The turns held by the extractor cylinder 12 when extraction is complete are removed without difficulty, as the last part of the wire rod end portion withdrawn from the laying guide does not remain constrained to the extractor cylinder but instead tends to unwind from it, gradually dragging with it the turns already wound around the cylinder. The removal of the turns is also facilitated by the braking action of the fluid jets acting on the extractor cylinder in the direction of unwinding.

The invention described is susceptible to modifications, all of which fall within the scope of the inventive idea. Thus different means may be provided for the relative rotation of the extractor cylinder than those described, for example a motor could be disposed inside the laying cone and rotating with it, the motor rotating the extractor cylinder with a speed such that the effect of the two superimposed rotations causes the extractor cylinder to remain at rest or rotate slightly in the opposite direction to the direction of rotation of the laying cone. The electricity supply for the motor may be obtained by ring connection at the area of support of the laying head 7, 8 in the frame 2. Means may also be provided for automatically adjusting the flow of the jets delivered by the nozzles 14 during the extraction operation.

I claim:

1. A device for extracting the end portion of wire rod or the like from the laying guide of a coiler disposed at the outlet of a rolling mill and having a rotatable laying cone supporting said laying guide, comprising an extractor cylinder idly supported by said laying cone of said coiler and coaxial thereto, said cylinder having an external diameter less than the internal diameter of the turns formed by said laying cone, and a length sufficient to comprise at least one of said turns, and means for maintaining a relative speed between said extractor cylinder and said laying cone, wherein said means for maintaining a relative speed between said extractor cylinder and said laying cone comprise a plurality of fixed nozzles arranged to feed fluid jets on to shaped surfaces of said extractor cylinder, the orientation of said jets and said surfaces being such as to create a couple opposing the rotation of said extractor cylinder in the direction of rotation of said laying cone.

2. A device as claimed in claim 1, further comprising means for adjusting the flow of said fluid jets, said means being adjustable so as to keep said extractor cylinder at rest or in slow rotation in the opposite direction to the direction of rotation of said laying cone, at least at the beginning of extraction.

3. A device as claimed in claim 1, further comprising a tank below said coiler containing a cooling fluid, in which said coils are deposited from said laying cone, a conduit between said nozzles and said cooling fluid and a pump for supplying said cooling fluid to said nozzles.

* * * * *